United States Patent [19]

Gianfranco

[11] Patent Number: 4,587,901

[45] Date of Patent: May 13, 1986

[54] PLATE HOLDING ROLLER PARTICULARLY FOR FLEXOGRAPHIC PRINTING APPLICATIONS

[75] Inventor: Gibellino Gianfranco, Trino Vercellese, Italy

[73] Assignee: Officine Meccaniche G. Cerutti S.p.A., Italy

[21] Appl. No.: 631,856

[22] Filed: Jul. 18, 1984

[30] Foreign Application Priority Data

Jul. 29, 1983 [IT] Italy ..... 22329 A/83

[51] Int. Cl.[4] ..... B41F 1/28

[52] U.S. Cl. ..... 101/415.1

[58] Field of Search ..... 101/378, 415.1, DIG. 12

[56] References Cited

U.S. PATENT DOCUMENTS

| | | | |
|---|---|---|---|
| 1,839,722 | 1/1932 | Aitchison | 101/378 |
| 2,105,452 | 1/1938 | Busk | 101/415.1 |
| 2,243,195 | 5/1941 | Crafts | 101/415.1 |
| 3,008,410 | 11/1961 | Bryer | 101/415.1 |
| 3,276,364 | 10/1966 | Langer | 101/415.1 |
| 3,276,365 | 10/1966 | Langer | 101/415.1 |
| 3,335,663 | 8/1967 | Harenza | 101/415.1 |
| 3,824,928 | 7/1974 | Langer | 101/415.1 |
| 3,913,480 | 10/1975 | Danner | 101/378 |
| 3,921,780 | 11/1975 | Gentzlinger | 400/124 |
| 4,068,586 | 1/1978 | Frey | 101/415.1 |

FOREIGN PATENT DOCUMENTS

| | | | |
|---|---|---|---|
| 1223614 | 6/1960 | France | 101/415.1 |
| 170309 | 9/1954 | Sweden | 101/415.1 |

*Primary Examiner*—Edgar S. Burr
*Assistant Examiner*—William L. Klima
*Attorney, Agent, or Firm*—Webb, Burden, Robinson & Webb

[57] ABSTRACT

A plate holding roller particularly for flexographic printing, wherein the roller is formed with a groove provided with a securing means extending over one half the roller length, the remaining roller half has a circular cross-section longitudinal pocket therein, said pocket receives a supporting body pivotally therein which is also formed with a longitudinal groove having a means of securing the plate ends, and said supporting body can be released from and locked into its relative position to the plate holding roller.

7 Claims, 3 Drawing Figures

PLATE HOLDING ROLLER PARTICULARLY FOR FLEXOGRAPHIC PRINTING APPLICATIONS

BACKGROUND OF THE INVENTION

This invention relates to a plate holding roller particularly for flexographic printing applications.

It is a known fact that plate holding rollers of this type have been formed, in their outer shrouds, with a longitudinal groove which accommodates known locking devices for securing the ends of the printing plates, wrapped around the roller circumference.

Also known is that, in general, each roller is to accommodate two discrete plates laid adjacently each other. With the aid of conventional securing means, such as spring or camming means no further discussed herein, the two adjacent plates are secured with one end in the longitudinal groove, and then wrapped around the roller to be again secured with the opposite ends in the groove.

It may be appreciated that with such prior arrangements for securing the ends of adjacent plates, no adjustment ability is afforded in the circumferential direction between the plates. This requires that special care be taken in preparing the plates with photo-mechanical methods to provide precision made plates. Furthermore, alignment holes and pins must be used if the plates are to be brought to mutual register.

However, it is not uncommon for the plates to be imperfectly made, and hence out of register when placed adjacently on a common plate holding roller. This often involves the need for laborious operations, which would be to some extent improvised and not always quite successful, in order to locate the two plates on the roller at such mutual positions as they are in true register. If the margin for error between the plates exceeds a given magnitude, then it becomes necessary to re-make at least one of the plates to remove the error condition. This takes considerable and precious time during the installation of the plates on the plate holding roller, while it is not unusual for the related proof test runs to last more than a couple of hours. This drawback is the more heavily felt where the printing of a daily newspaper is to be started.

SUMMARY OF THE INVENTION

It is an object of this invention to provide a novel plate holding roller which can accommodate two adjacently placed plates and allow registration, in the circumferential direction to the roller, between the two adjacent plates, thereby the two plates can be positioned and mutually registered in a fast, reliable, and highly accurate manner.

This object is accomplished, according to the invention, by that the plate holding roller is formed with a groove incorporating a securing means extending over one half the roller length, that the remaining roller half has a circular cross-section longitudinal pocket therein, said pocket pivotally accommodating a supporting body also formed with a longitudinal groove provided with a conventional securing means, and that said supporting body can be released from and locked into the relative position thereof to said plate holding roller.

An arrangement as provided by the invention affords the ability to shift by small amounts one plate relatively to the adjacent fixed plate, thus enabling the required plate adjustment and positioning operations to be carried out rapidly and accurately with the roller at a standstill.

Further advantages and essential features of this invention are pointed out in the following description, dependent claims, and accompanying drawings.

BRIEF DESCRIPTION OF THE DRAWINGS

The invention will be next described in detail with reference to an exemplary embodiment thereof, as illustrated in the accompanying drawings, where.

DESCRIPTION OF THE PREFERRED EMBODIMENT

Figure 1:
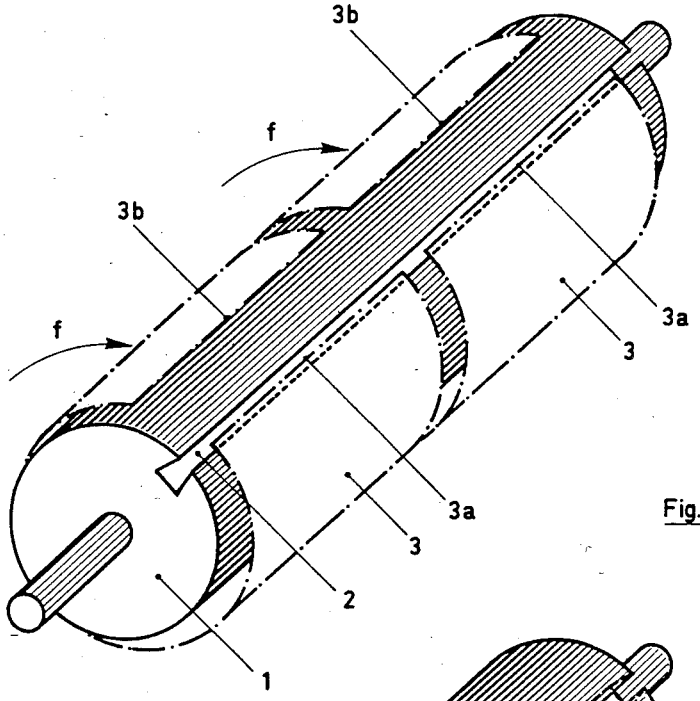
FIG. 1 is a perspective view showing schematically a plate holding roller of conventional design.

As shown in FIG. 1 of the drawings, a plate holding roller 1 of conventional design is formed with a groove 2 extending over the entire length of the roller shroud. Mounted in said groove 2 are gripper devices, or alternatively spring or camming devices, effective to lock the ends of plates 3 after the latter have been wrapped around the roller 1. To this aim, and as shown diagrammatically in FIG. 1, the plates 3 are first locked with their ends 3*a* in the locking or securing devices housed in the groove 2, and then the plates 3 are wrapped around the circumference of the roller 1 in the direction of the arrows f, thereafter the ends 3*b* are secured in the groove 2. It will be appreciated how in this prior situation registering of the plates 3 in a circumferential direction to the roller 1 is quite difficult, if not altogether impossible.

Figure 2:
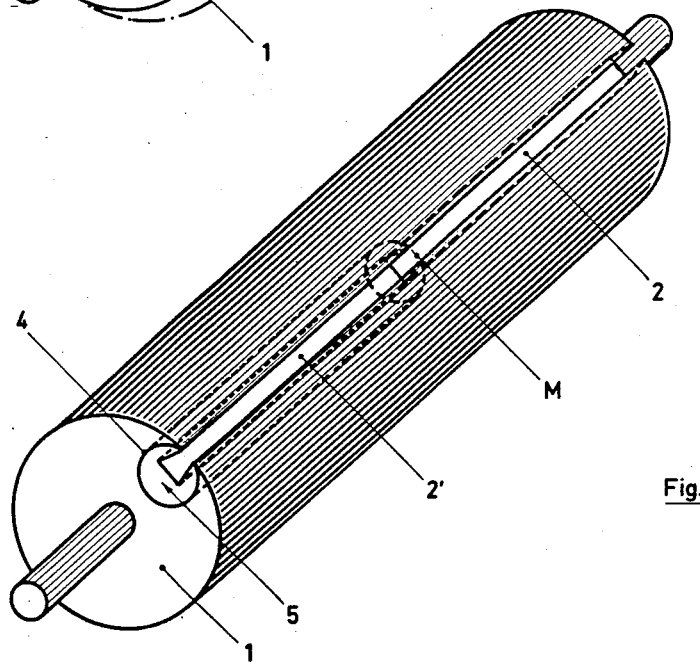
FIG. 2 shows schematically a plate holding roller incorporating the device of this invention.

FIG. 2 shows again a plate holding roller 1, which has on one side a conventional axial groove 2 extending, however, no farther than the center M of the roller 1, as viewed in the axial direction. The remainder of the roller 1 is formed instead with a longitudinal pocket 4 having a circular cross-section configuration and advantageously formed with a boring technique.

Said pocket 4 receives a supporting body, generally indicated at 5, for rotation about its longitudinal axis, and said supporting body 5 has a longitudinal groove 2′ which is aligned to the fixed groove 2 formed in the roller, e.g. as by milling.

Figure 3:
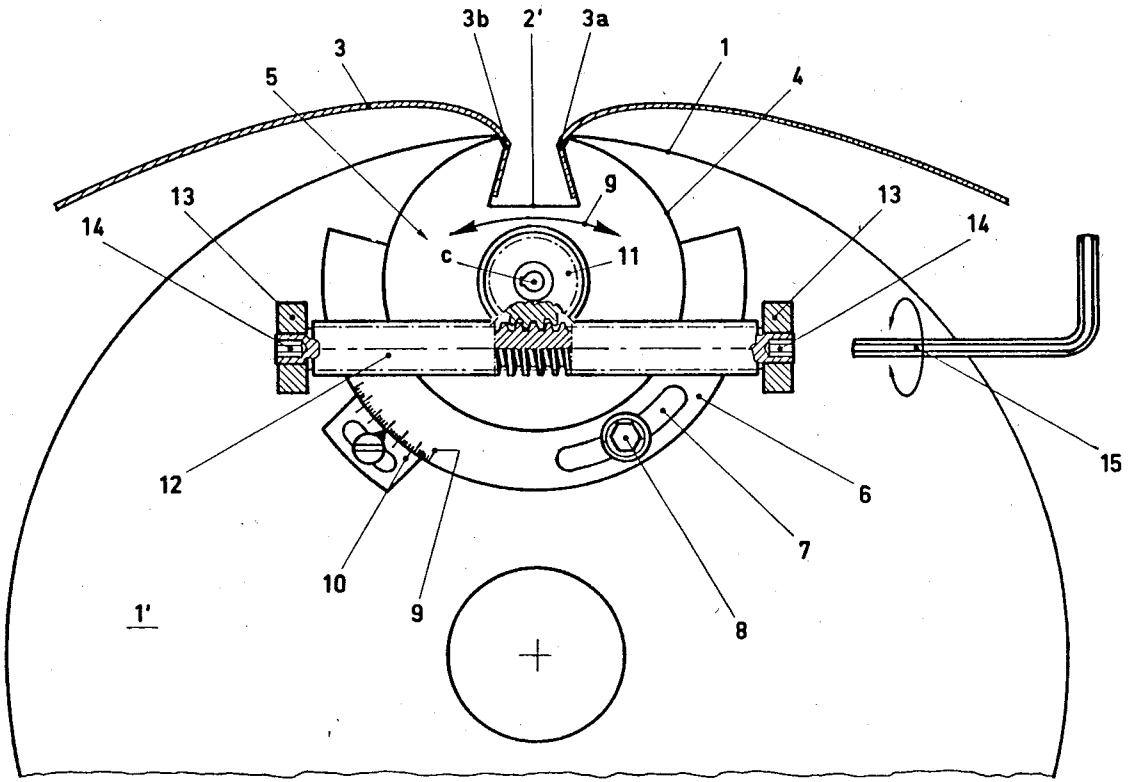
FIG. 3 is a fragmentary end view of the plate holding roller schematically illustrating the inventive device.

FIG. 3 shows more in detail a front view of the device of this invention. As described hereinabove, the roller 1 has on one side a pocket 4 of circular cross-section, said pocket 4 accommodating a supporting body, generally indicated at 5, therein. The supporting body can perform a rotary movement in the direction of the arrow g; it also has a groove 2′ which conventionally accommodates securing means for securing the ends 3*a* and 3*b* of the plate 3.

At the end 1′ of the roller 1, the supporting body 5 stands slightly proud of the roller to receive a half flange formation 6 rigid with the supporting body 5. Advantageously, the half flange 6 is apertured with a window 7, wherethrough a locking screw 8 is passed which is threaded into the body of the roller 1. Said half flange 6 is further provided, at a suitable location, with an indexed scale 9 cooperating, for example, with a pointer or vernier 10 attached to the roller 1.

Furthermore, at the center C of the supporting body 5, a helical wheel 11 is made rigid therewith which engages with a small threaded shaft 12 supported rotatably on small supports 13 attached to the roller 1. The ends of the threaded shaft 12 are formed with contoured pockets 14 for the insertion of a wrench 15, such as an Allen wrench 15.

It will be apparent that the unbalance set up by the presence of the adjusting device 5 must be corrected on the plate holding roller 1 with appropriate counterweights. Expediently, the thread on the shaft 12 would be a micrometric thread to enable adjustment and registration within a tenth of a millimeter.

The device according to this invention operates basically in the following manner.

If, after installing the two plates 3 onto the roller 1, a test run reveals that there exists between the adjacent plates 3 an out-of-register situation, then with the roller 1 held stationary, one end *3a*, respectively *3b*, is released from the securing device located within the groove 2' in the supporting body 5. Simultaneously therewith, the screw 8 is loosened to enable the body 5 to perform a small rotational movement in the direction of the arrow g (FIG. 3). Now, by inserting a tool 15 into one of the pockets 14 in the threaded shaft 12 and turning the tool 15, the threaded shaft will be caused to transmit to the gear wheel 11 a controlled rotary movement driving the supporting body 5 rotatively in the desired direction. To make ascertainment of the amount of movement required easier, the half flange 6 is advantageously provided with an indexed scale cooperating, for example, with a pointer or vernier, generally indicated at 10. On completion of the registering operation, the screw 8 is retightened to thus exactly determine the position of the supporting body 5. Thereafter, the previously released end *3a*, respectively *3b*, is again secured within the groove 2'.

With the operations described hereinabove, the ability is afforded of registering the plate 3 received in the fixed groove 2 with respect to the plate 3 received in the groove 2' of the adjustable body 5.

If required, of course, the roller 1 may also be provided with two supporting bodies 5, adjustable and arranged sequentially in the longitudinal direction of the roller 1.

I claim:

1. A plate holding roller for flexographic printing applications comprising a roller having a longitudinal groove extending over one half the roller length, said groove provided with means for securing the ends of a plate thereto, said plate not being adjustable relative to said roller while secured on said roller; a circular cross-section longitudinal pocket formed in alignment with said groove in the remaining half of the roller length, said pocket being substantially tangential to the surface of said roller; a supporting body rotatably mounted within said pocket, said supporting body including a longitudinal groove extending the entire length of said supporting body and means for securing the ends of a plate to said supporting body; and means for selectively releasing said supporting body for rotation in said pocket relative to said roller without releasing the means securing the ends of the plate attached thereto, and locking said supporting body relative to said roller, whereby the position of a plate mounted to the roller by said supporting body can be adjusted relative to a plate mounted to the remainder of the roller.

2. A plate holding roller according to claim 1 including a half flange formation rigid with one end of said supporting body, said half flange formation having an aperture formed therein to provide a window and a locking screw threaded into said roller and extending through said window.

3. A plate holding roller according to claims 1 or 2 wherein said half flange formation is provided with an indexed scale and a pointer attached to said roller cooperating with said indexed scale.

4. A plate holding roller according to claims 1 or 2 wherein said half flange formation is provided with an indexed scale cooperating with a vernier attached to said roller.

5. A plate holding roller according to claim 1 including a gear wheel rigid with the center portion of said rotatable supporting body at the end of said rotatable supporting body, a threaded shaft in driving engagement with said gear wheel and means fixed to the end of said roller supporting said threaded shaft in a rotatable but not axially movable fashion.

6. A plate holding roller according to claim 5 wherein the ends of said threaded shaft are formed with contoured pockets for the insertion of a contoured tool therein.

7. A plate holding roller according to claim 5 wherein the shaft thread is a micrometric thread.

* * * * *